US010504645B2

(12) United States Patent
Dimitrovski

(10) Patent No.: US 10,504,645 B2
(45) Date of Patent: Dec. 10, 2019

(54) GAPLESS CORE REACTOR

(71) Applicant: UT Battelle, LLC, Oak Ridge, TN (US)

(72) Inventor: Aleksandar D. Dimitrovski, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 121 days.

(21) Appl. No.: 15/147,630

(22) Filed: May 5, 2016

(65) Prior Publication Data

US 2017/0323717 A1 Nov. 9, 2017

(51) Int. Cl.

| | |
|---|---|
| ***H01F 30/12*** | (2006.01) |
| ***H01F 27/24*** | (2006.01) |
| ***H01F 27/33*** | (2006.01) |
| ***H01F 37/00*** | (2006.01) |
| *H01F 17/04* | (2006.01) |

(52) U.S. Cl.
CPC ..... *H01F 27/24* (2013.01); *H01F 27/33* (2013.01); *H01F 37/00* (2013.01)

(58) Field of Classification Search
CPC ..... H01F 27/33; H01F 27/34; H01F 27/341; H01F 2017/0093
USPC ..... 336/5, 221, 220, 222
See application file for complete search history.

(56) References Cited

U.S. PATENT DOCUMENTS 1,835,115 A * 12/1931 Kouyoumjian ..... G05F 1/33 363/76
2,057,463 A * 10/1936 West ..... G05F 1/34 307/33
2,443,198 A * 6/1948 Sallach ..... F41G 7/30 235/132 E
2,598,617 A * 5/1952 Stimler ..... H03F 9/02 336/160
2,767,371 A * 10/1956 Beaubien ..... H01F 29/14 323/334
2,866,943 A * 12/1958 Ringelman ..... H01F 29/14 363/76
3,032,682 A * 5/1962 Lord ..... H05B 41/391 315/144
3,127,551 A * 3/1964 Lingle ..... H02M 3/3384 315/241 P
3,195,083 A * 7/1965 Wetherill ..... H01F 37/005 336/12
3,195,087 A * 7/1965 Welch ..... H01F 37/00 336/208

(Continued)

FOREIGN PATENT DOCUMENTS

EP 0650173 A1 * 4/1995 ..... H01F 30/12

*Primary Examiner* — Alexander Talpalatski
*Assistant Examiner* — Joselito Baisa
(74) *Attorney, Agent, or Firm* — Benesch, Friedlander, Coplan & Aronoff LLP

(57) ABSTRACT

A gapless core reactor includes a saturable magnetic core having reactor legs without air gaps and multiple windings. The windings are each wound around a common leg, spaced apart from each other and connected in counter series. The windings are configured such that a magnetic flux generated from an alternating current flowing through the windings generates a plurality of substantially equal and counter magnetic fluxes flowing through two or more separate magnetic circuits.

21 Claims, 5 Drawing Sheets
(5 of 5 Drawing Sheet(s) Filed in Color)

(56) References Cited

U.S. PATENT DOCUMENTS

| | | | | | |
|---|---|---|---|---|---|
| 3,731,752 | A * | 5/1973 | Schad | E21B 7/04 | 175/45 |
| 4,176,335 | A * | 11/1979 | Charpentier | H01F 27/2866 | 336/180 |
| 4,350,934 | A * | 9/1982 | Spreadbury | H05B 41/18 | 315/194 |
| 4,462,165 | A * | 7/1984 | Lewis | G01C 17/30 | 33/355 R |
| 4,763,093 | A * | 8/1988 | Cirkel | H01F 30/10 | 336/181 |
| 4,902,942 | A * | 2/1990 | El-Hamamsy | H01F 29/14 | 315/276 |
| 6,317,021 | B1 * | 11/2001 | Jansen | H01F 27/24 | 336/155 |
| 2004/0032315 | A1 * | 2/2004 | Illingworth | H01F 3/10 | 336/212 |
| 2007/0263335 | A1 * | 11/2007 | Shudarek | H03H 7/427 | 361/113 |

* cited by examiner

GAPLESS CORE REACTOR

STATEMENT REGARDING FEDERALLY SPONSORED RESEARCH AND DEVELOPMENT

This invention was made with United States government support under Contract No. DE-AC05-00OR22725 awarded by the United States Department of Energy. The United States government has certain rights in the invention.

BACKGROUND

1. Technical Field

This disclosure relates to high power system devices and more specifically to devices that reduce the size, cost of manufacture, and audible noise produced by ferromagnetic reactors.

2. Related Art

Some ferromagnetic reactors avoid core saturation by inserting air gaps into some or all of the legs of a ferromagnetic core. The air gaps increase the reluctance of the reactor legs and limit the amount of flux that even small ac load currents can generate.

Typically, ceramic spacers are inserted into the legs of core to create equivalent air gaps. The spacers maximize the use without saturation and minimize magnetic flux losses and reduce core heating.

However, air gaps also create noise. The discontinuities between the ferromagnetic laminates and the ceramic spacers amplify the 120 Hz humming sound (in a 60 Hz power system) that reactors create when excited by an ac source. To mitigate its psychoacoustic effects, some ferromagnetic reactors operate at lower flux densities making suboptimal use of the ferromagnetic cores.

In the manufacture of cores, the characteristics of a reactor can be altered significantly if ferromagnetic laminates are not stacked precisely. The addition of ceramic spacers further complicates the manufacturing process and makes the manufacture of saturable cores more expensive. The end result is a ferromagnetic reactor core that is large, heavy, noisy, and expensive to manufacture. The detrimental effects scale up with power rating with nearly all of the energy concentrated in the air gaps.

DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENTS

A gapless reactor core provides a controllable reluctance for magnetic flux without providing physical air gaps in the core legs. The reactors include a laminate magnetic core enclosing a window space, a plurality of magnetic circuits, and one or more coils (also referred to as windings) of N turns that are excited by a local or remote ac source. The windings are configured in such a way that the windings produce a substantially equal flux and counter flux that separates the magnetic circuits that pass flux through separate and common core legs. The layout and sourcing of the windings control the flux flow through portions of the core. The core reluctance, which may be compared to the resistance of an electric circuit, has a value that depends on the material that makes up the core. The reluctance of the window space remains constant regardless of the source current. This results in an increase in flux density without saturation, which is proportional to the increase in both current and magnetomotive force, and a flux distribution confined to the core and window space. This means the disclosed gapless core manages and utilizes stray flux flowing from the core legs through the enclosed window space.

The core comprises a saturable material. In some systems, the core has different core geometries and structures and may be made of one or more magnetizing materials such as steel, iron, ferrous alloy(s), nickel iron, or other saturable materials for example. Different cross-sections of the core may have different saturation levels due to flux flow, use of saturable materials, and other factors. The cross-sections may comprise many shapes and geometries that may include substantially rectangular, circular, or oval shapes, for example.

Figure 1:
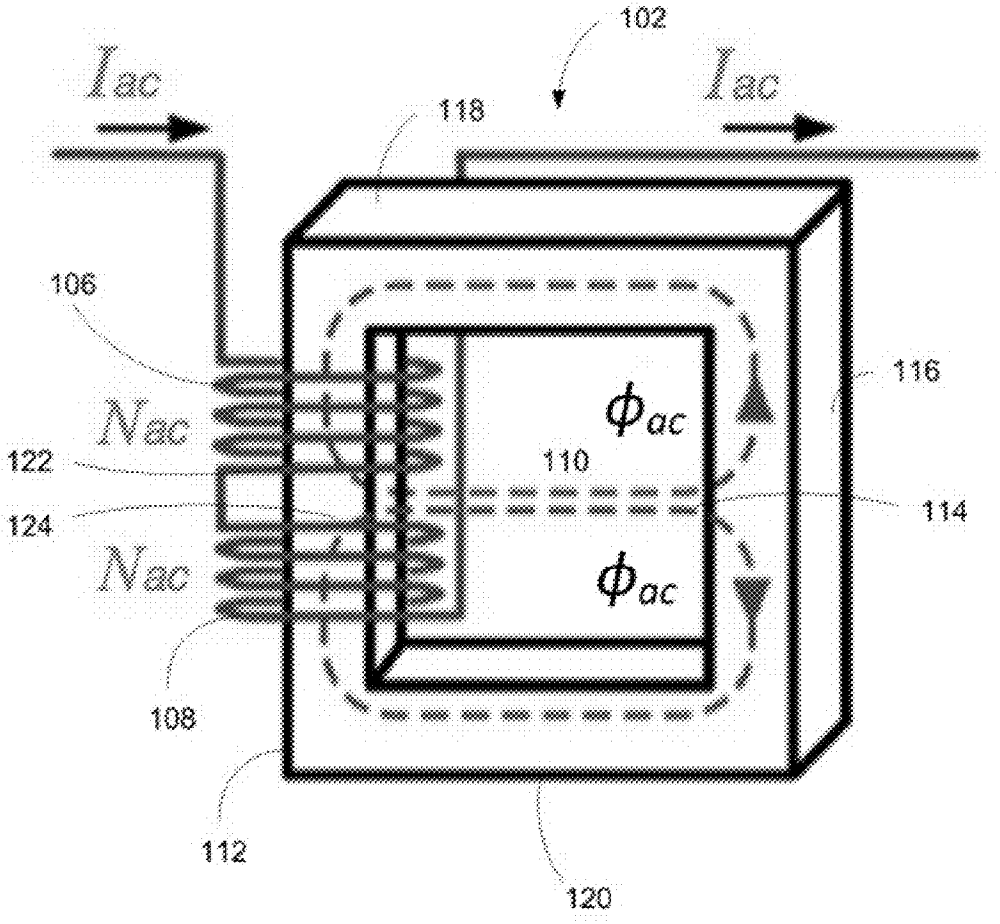
FIG. 1 is a gapless ferromagnetic core inductor.

FIG. 1 is a front view of a gapless core reactor 102 that is excited by an ac source (not shown) driving two ac coils 106 and 108 connected in counter-series. The ac coils 106 and 108 are connected counter-series in the sense that the connection enables the ac coils 106 and 108 to generate substantially equal ac flux and counter flux (fluxes of opposing polarity) that separate the flux flows from each other and confine the flux distribution to the gapless core 102 and an equivalent air core—an internal window 110 filled with air or other non-magnetic material, gas, or liquid. In effect the balanced and symmetrical separation between the ac coils 106 and 108 and counter series connection generate a virtual air gap 114 within at least two legs of the gapless core 102 that prevents the flux from flowing continuously through the gapless core 102 and between the two circuits. In one implementation, one of the ac coils 106 in cylindrical form is wound in a helix in a clockwise configuration around a proximal outer leg 112 terminating in series at a second ac coil 108. The second ac coil 108 also cylindrical in form and comprising the same number of turns (or substantially the same number of turns as first ac coil 106) in a counter clockwise configuration around the proximal outer leg 112. In this implementation, the legs of the gapless core 102 have substantially uniform magnetic cross-sections with no air gaps or non-magnetic material within each of the joining legs and connecting portions that makes up the gapless core 102 and enclose the air or other non-magnetic material, gas, or liquid enclosed by the window space 110.

The ac coils 106 and 108 wound around the proximal outer leg 112 are positioned and connected in series. The ac coils 106 and 108 are in a substantially serial alignment with each linear end segment 122 and 124 separated by a substantially equidistant space. While the length of the space separating the substantially parallel end segments 122 and 124 of the ac coils 106 and 108 is exaggerated for clarity, in some systems the distance between the end segments 122 and 124 of the ac coils 106 and 108 is substantially equal to the width of the cross-sectional area of the proximal leg 112 of the gapless core 102. In other systems the distance is larger or smaller depending on the desired reactance. When energized by a local or a remote common ac source, substantially equal and counter ac fluxes pass through the air or other non-magnetic material, gas, or liquid, enclosed by window space 110 to the distal outer leg 116 of the gapless core 102 and through separate joining portions of the joining legs 118 and 120 of the gapless core 102 before flowing through portions of the proximal outer leg 112 of the gapless core 102. The opposing polarity and substantially equal magnitude of the ac fluxes flowing from the spaced apart and substantially identically shaped ac coils 106 and 108 flow along separate circuit paths separated by the virtual air gap 114 that extends through the air or other non-magnetic material, gas, or liquid, enclosed by the internal window space 110 and through the proximal 112 and distal 116 outer legs of the gapless core 102. This configuration maintains the gapless core 102 in an unsaturated state.

The gapless core 102 shown in FIG. 1 is a single-phase inductor, meaning the gapless core 102 can be used in one of the phases of a polyphase ac power system. In a polyphase system, a bank of gapless cores 102 may be used so that one or more gapless cores 102 are connected to each conductor exclusively (other than the neutral) carrying alternating current. In three-phase systems, at least a bank of three gapless cores 102 is connected such that each gapless core 102 is connected to a current carrying conductor with the optional fourth conductor (the neutral) free of the inductive load.

Figure 2:
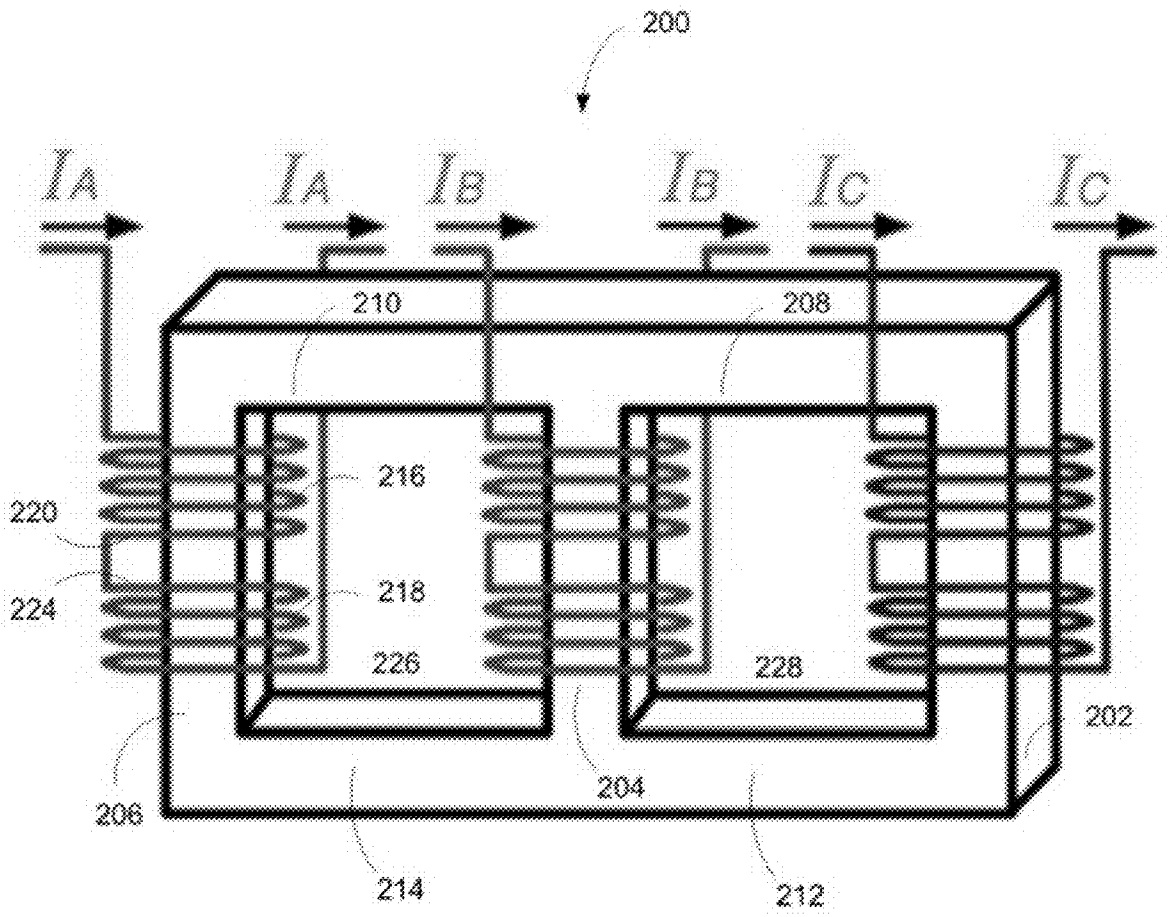
FIG. 2 is a three-phase ferromagnetic gapless core inductor.

An alternate system includes a three-legged gapless core 200 (one leg per phase) having a distal leg 202, a center leg 204, a proximal leg 206 and four joining portions 208-214 as shown in FIG. 2. Like the single phase gapless core 102 system shown in FIG. 1, the proximal leg 206, center leg 204 and distal leg 202 of the three-legged gapless core 200 are the locus that at least two of the six or more ac coils orbit around. At least two orbiting and transitional ac coils orbit around each of the proximal leg 206, the center leg 204 and the distal leg 202, respectively. On the proximal leg, for example, one of the ac coils 216 in cylindrical form is wound in a helix in a clockwise configuration (a first orbiting configuration) around the proximal outer leg 206 terminating in a counter series connection at a second ac coil 218. The second ac coil 218 also cylindrical in form and comprising the same number of turns or substantially the same number of turns as first ac coil 216 in a counter clockwise configuration (or a second opposite orbiting configuration) around the proximal outer leg 206. In this system the center leg 204 and the distal leg 202 of the three-legged gapless core 200 also have pairs of ac coils: one in cylindrical form that is wound in a helix in a clockwise configuration (or a first orbiting configuration) and the other cylindrical in form and comprising the same number of turns (or substantially the same number of turns as prior ac coil) in a counter clockwise configuration (or a second opposite orbiting configuration) around the respective legs with the result looking like a coil spring. To maintain balance, the special separation in the serpentine ac coils is substantially equal.

On the proximal leg 206, center leg 204 and the distal leg 202 the ac coil pairs are in a substantially serial alignment on each leg with each end segment (220 and 224 for ac coils 216 and 218, for example) separated by a substantially equidistant space. While the length of the space separating the substantially parallel end segments of the ac coils is again exaggerated for clarity, in some systems the distance between the end segments of the ac coils is substantially equal to the widths of the cross-sectional areas of the legs of the three-legged gapless core 200. In other systems the distance is larger or smaller depending on the desired reactance. The distance between the two coils is one of the parameters that determine the reactance (inductance). As shown in FIG. 2 six ac coils (two per leg connected in counter series) are symmetrically balanced on a leg relative to the other legs. Further, the spacing on each of the legs 202-206 is substantially equal effectively avoiding system imbalances.

When energized by a local or a remote balanced three-phase ac source (not shown), a substantially equal flux and counter flux pass through the outer legs 202, 206, and 208-214. Due to the phase difference of the ac source, the ac fluxes generated by one of the pairs of coils orbiting around the distal 202, center 204, or proximal 206 legs reaches its peak at one third of the cycle after the current (and magnetomotive force) conducted through the pairs of coils of one of the other core legs reaches its maximum and one third of a cycle before current conducted through the pairs of coils orbiting around the remaining core leg reaches its maximum. The outer legs (e.g., the proximal and distal legs 202 and 206) complete the magnetic circuits through the air or other non-magnetic material, gas, or liquid, enclosed by window spaces 226 and 228 that pass the flux and counter flux back to the energized leg.

Figure 3:
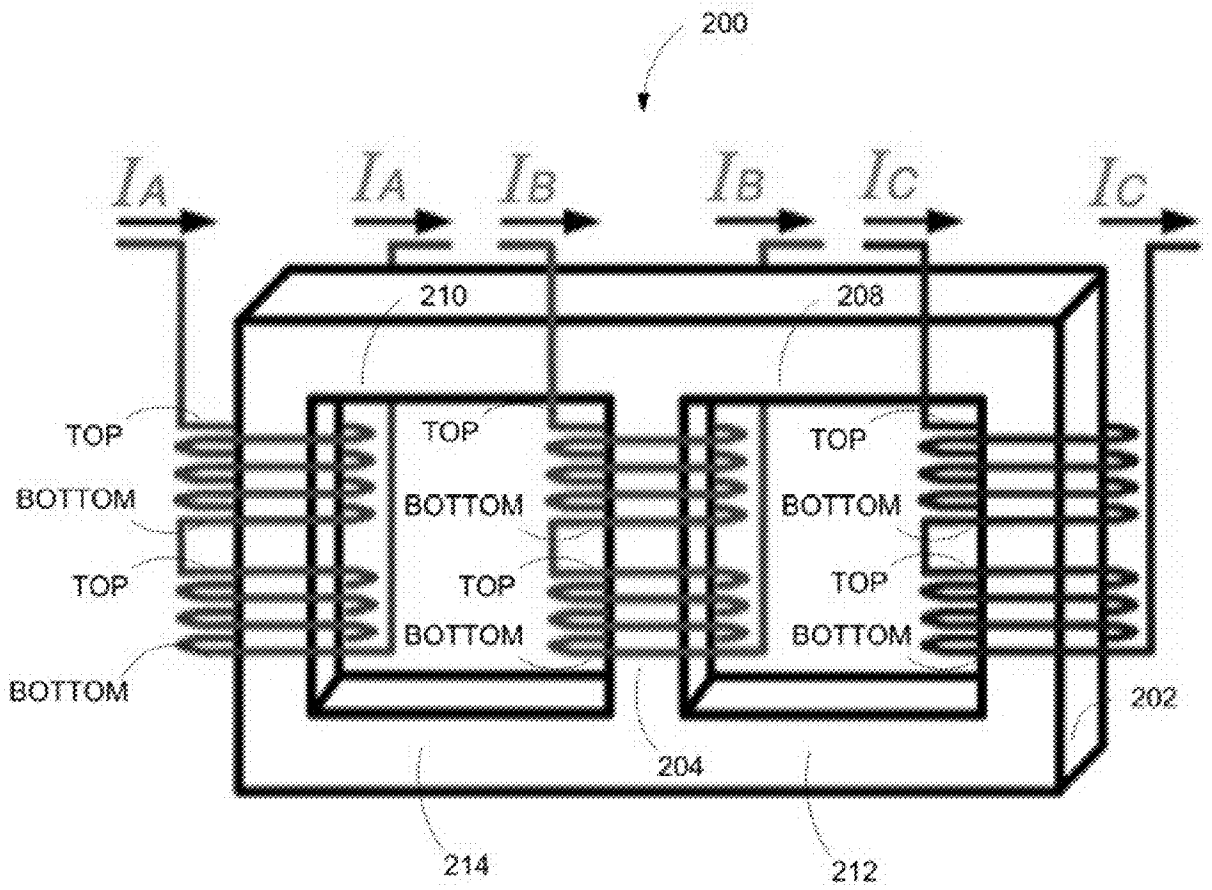
FIG. 3 is the three-phase ferromagnetic gapless core inductor with reference designations.

As described, the ac coils that orbit about the legs are wound in two directions. The change in direction shown at the connecting point occurs substantially in the middle of a portion of virtual air gap 114 at or near a midpoint of the leg(s) of the gapless reactors. When the ac coils are wound in one direction of a given leg of a gapless core reactor, the bottom end of the top winding is connected to the bottom end of the bottom winding (see FIG. 3) to achieve the compensated correction that renders the virtual air gap 114 when the coils are excited. With physical separation described above are maintained between the coils that form the coil pairs, the bottom-to-bottom and top-to-top connection scheme renders the counter series connection that maintains the flux and counter flux separation and separates the circuits.

Figure 4:
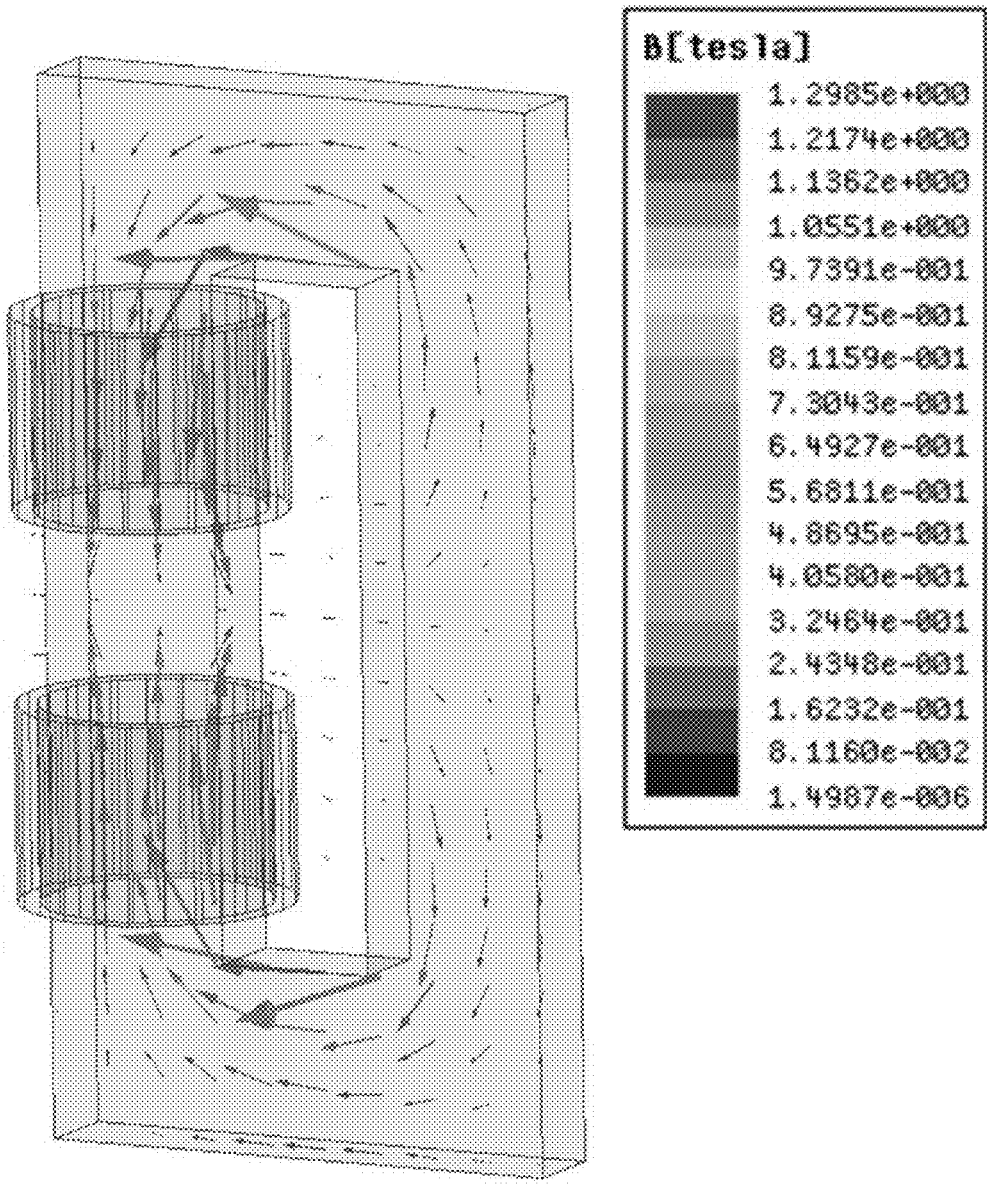
FIG. 4 is modeled gapless core reactor.
Figure 5:
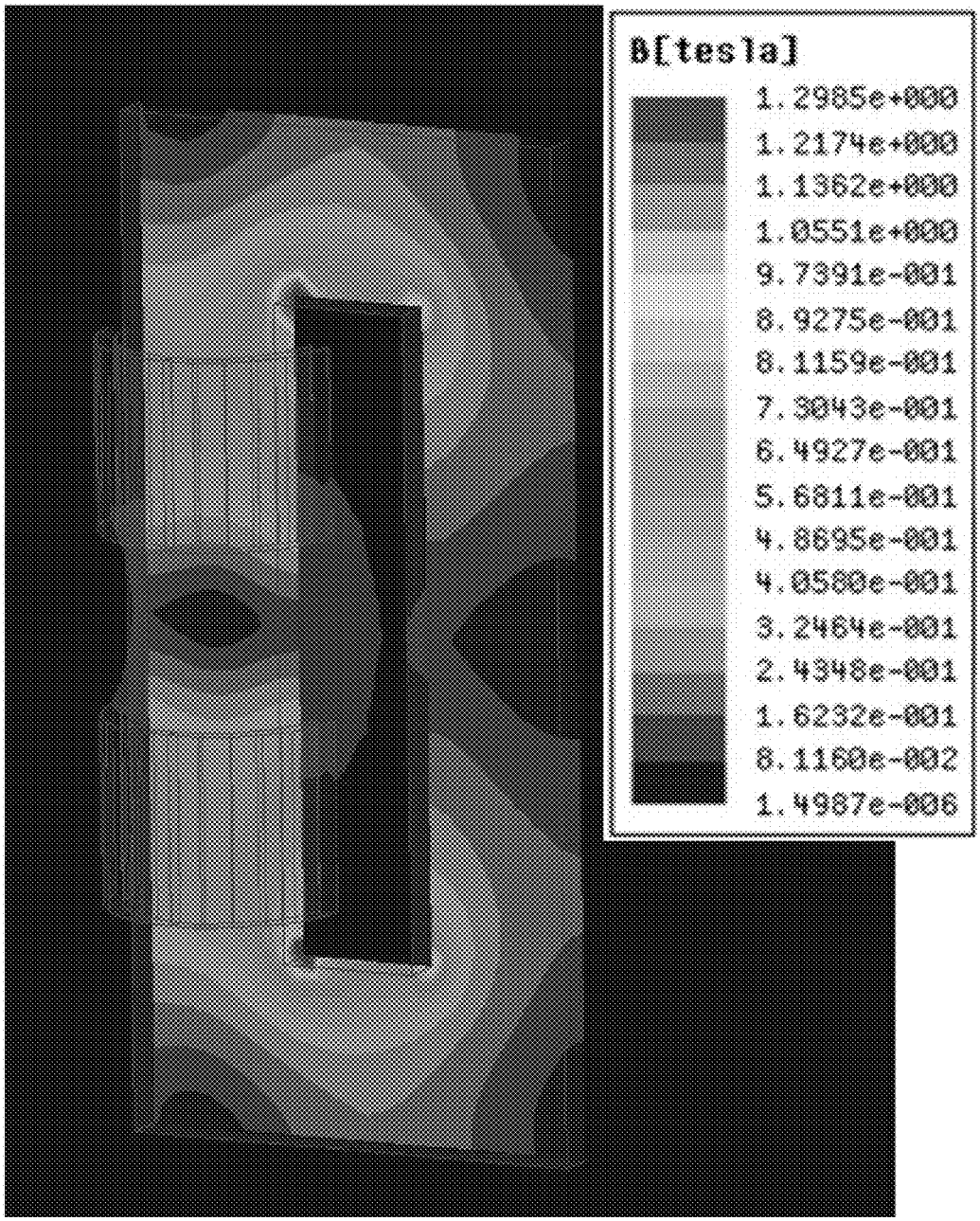
FIG. 5 shows the magnetic flux density in a central cross-sectional plane of the gapless core reactor of FIG. 4.

A modelled gapless core reactor was built in ANSYS Maxwell®—a commercial electromagnetic field simulation software based on finite element analysis. The model and the results for the magnetic field distribution from the simulation are shown in FIGS. 4 and 5.

The three dimensional model includes four elements: two substantially uniform cylindrical blocks having ferromagnetic characteristics material create the gapless core and two copper cylinders were modeled to represent the coil pairs and counter series connections. In other simulations, the core is simulated as stacks of thin laminated sheets with different widths to approximately form either round or oval cross section. The coils, are modeled from conductors wound around portions of the core with multiple turns in a helix-like structure.

From the configuration and the symmetry of the system, the fluxes produced by the two coils (e.g., the flux and counter flux) force each other to pass through the core window. Also, the flux distribution in the core is confined within the core and the internal window space. The latter result is a strong benefit for practical implementations because unmanaged stray flux can have detrimental effects to an application or circuit.

The proposed gapless reactors can directly replace any type of inductor with a magnetic permeable core and may be used in power system applications (transformers, reactors, magnetic amplifiers, filters, etc.). The gapless core reactors are simpler and perform better than ferromagnetic core inductors with gaps that are often used in power system applications. The systems can replace air-core inductors and avoid operating in a saturated state even during large fault current conditions. As the current increases both the self-inductance and mutual inductance change by the same or similar amount and, hence, keep the overall inductance value substantially constant. As a result, the gapless core reactors are revolutionary devices.

The gapless core reactors may be installed in shunt or in series with any power line including high voltage (>1 kV), extra high voltage (>230 kV), or ultra-high voltage (>765 kV) power distribution and transmission lines and may include additional coils and coil pairs about one or more legs of the gapless cores. The small relative size of the (magnetic) gapless core reactors relative to typical constructions that control high voltage power flow may allow the gapless core reactors to be installed with an enclosure at the elevated potential of the power line voltage. The gapless core reactors may be deployed system wide in distributed power system architectures and may be self-monitored and controlled. Some gapless core reactors implemented in combinations of hardware including SN 13984196 describing power flow control using distributed saturable reactors that is incorporated herein by reference. And, some gapless core reactors are remotely monitored and controlled through a wireless or physical communication link from one or more geographically remote locations.

The term "coupled," disclosed in this description, may encompass both direct and indirect coupling. Thus, first and second parts are said to be coupled together when they directly contact one another or share electromagnetic field, as well as when the first part couples to an intermediate part which couples either directly or via one or more additional intermediate parts to the second part. The term "substantially" or "about" encompass a range that is largely (ninety five percent or more), but not necessarily wholly, that which is specified. It encompasses all but a significant amount, such as a variance within five or ten percent. When devices are responsive to or occur in response to commands events, and/or requests, the actions and/or steps of the devices, such as the operations that devices are performing, necessarily occur as a direct or indirect result of the preceding commands, events, actions, and/or requests. In other words, the operations occur as a result of the preceding operations. A device that is responsive to another requires more than an action to (i.e., the device's response to) merely follow another action.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A gapless alternating current core reactor comprising:

a magnetic core, the core comprising a plurality of substantially uniform reactor legs without air gaps; and a single coil forming a plurality of windings, each wound around a common leg, wherein the plurality of windings having a first windings wound around the common leg in a first direction, and followed by a second windings wound around the common leg in a second direction opposite to the first direction, such that the first windings and the second windings of the single coil are continuous, in series, spaced apart from each other and in counter series connection;

where the first and the second windings are configured in such a way that a magnetic flux generated from an alternating current flowing through the first and the second continuous windings generate a substantially equal magnetic flux and a counter magnetic flux flowing through two or more separate magnetic circuits that repel each other absent a ground where energized by an alternating current source;

where the first and the second windings each include parallel linear end segment positioned between the first and the second windings and separated by an equidistant core separation that is substantially equal to a width of a cross-sectional area of the substantially uniform reactor legs.

2. The gapless alternating current core reactor of claim 1 where the plurality of uniform reactor legs encloses an air core.

3. The gapless alternating current core of claim 1 where the first and the second windings are symmetrical and is separated by a uniform space.

4. The gapless alternating current core of claim 1 where the first and the second windings wound around a common leg each having a same number of turns.

5. The gapless alternating current core of claim 1 where one of the first and the second directions is in a clockwise direction and the other of the first and the second directions is in a counter clockwise direction.

6. The gapless alternating current core of claim 1 where the first and the second windings are wound around a common leg in a common radial direction.

7. The gapless alternating current core of claim 1 where the counter series connection bridges an opposing configuration between the first and the second windings.

8. The gapless alternating current core of claim 1 where each of the first and the second windings are excited by an ac source.

9. The gapless alternating current core of claim 8 where the ac source is a remote ac source.

10. The gapless alternating current core of claim 1 where the magnetic core comprises a single core consisting of three legs and four joining core portions.

11. The gapless alternating current core of claim 1 further comprising a polyphase source in which each phase of the polyphase source drives a second plurality of windings on each of two other legs of the magnetic core that generate six magnetic circuits separated by a substantially uniform virtual air gap.

12. A three-phase gapless alternating current core reactor comprising:

a saturable magnetic core, the core comprising a plurality of reactor gapless legs; and a plurality of winding pairs, each winding pair formed from a single coil wound around a gapless leg of the plurality of reactor gapless legs, and within each winding pair comprising a first windings wound around a respective gapless leg in a first direction, and followed by a second windings wound around the respective gapless leg in a second direction opposite to the first direction, such that the first windings and the second winding are continuous, in series, spaced apart from each other and in a counter series connection;

where the first winding and the second windings are configured in such a way that a magnetic flux generated from an alternating current flowing through the first winding and the second windings generate two or more substantially equal and counter magnetic fluxes that repel each other and flow through separate and mutually exclusive magnetic circuits in the respective gapless leg; and where the first winding and the second winding each include parallel linear end segment positioned between the first and the second windings and separated by an equidistant core separation that is substantially equal to a width of a cross-sectional area of the reactor legs.

13. The three-phase gapless alternating current core reactor of claim 12 where the plurality of gapless legs encloses a plurality of air cores.

14. The three-phase gapless alternating current core reactor of claim 12 where the plurality of windings pairs are symmetrically positioned and within each pair comprise winding coils separated by a uniform space.

15. The three-phase gapless alternating current core reactor of claim 12 where each winding coil comprise the same number of turns.

16. The three-phase gapless alternating current core reactor of claim 12 where one of the first direction and the second direction is in a clockwise direction and the other one of the first direction and the second direction is in a counter clockwise direction.

17. A gapless alternating current core reactor comprising:

a saturable core, the saturable core comprising a plurality of legs; and a plurality of pairs of windings, each pair of windings wound around a separate leg, spaced apart from each other with the windings in each pair connected in a counter series relation about a common leg rendering separate circuits having separate inputs and separate outputs, wherein a first windings in each pair generate a substantially equal counter magnetic flux to a second magnetic flux generated by a second winding in each pair that is conveyed through portions of the plurality of legs and a portion of a plurality of window gaps enclosed by the plurality of legs when a plurality of alternating currents generated by separate alternating current sources flow through the plurality of the pairs of windings; where:

the first winding and the second winding each include a parallel linear end segment positioned between the first and the second windings and separated by an equidistant saturable core separation that is substantially equal to a width of a cross-sectional area of the plurality of legs.

18. The gapless alternating current core reactor of claim 17 where each of the plurality of pairs of windings are symmetrically balanced on a leg with respect to the other plurality of legs.

19. The gapless alternating current core of claim 17 where the first winding and the second winding have a symmetrical configuration.

20. The gapless alternating current core of claim 17 where the first winding and the second winding have a same number of turns.

21. The gapless alternating current core of claim 17 where the counter series relation comprises a configuration wherein the first winding traverses in a clockwise direction and the second winding traverses in a counter clockwise direction.

* * * * *